US005787319A

United States Patent [19]

Tomatsu

[11] Patent Number: 5,787,319

[45] Date of Patent: Jul. 28, 1998

[54] FIXING UNIT FOR USE IN IMAGE FORMING APPARATUS

[75] Inventor: Yoshiya Tomatsu, Kasugai, Japan

[73] Assignee: Brother Kogyo Kabushiki Kaisha, Nagoya, Japan

[21] Appl. No.: 819,434

[22] Filed: Mar. 17, 1997

[30] Foreign Application Priority Data

Apr. 11, 1996 [JP] Japan ..... 8-089285

[51] Int. Cl.[6] ..... G03G 15/20

[52] U.S. Cl. ..... 399/33; 219/216; 399/69; 399/122; 399/328

[58] Field of Search ..... 399/33, 67, 69, 399/122, 328; 219/216, 494; 347/156

[56] References Cited

U.S. PATENT DOCUMENTS

| | | | |
|---|---|---|---|
| 4,541,708 | 9/1985 | Shiegenobu | 399/33 |
| 4,696,561 | 9/1987 | Katoh et al. | 399/122 |
| 4,875,068 | 10/1989 | Pawlik et al. | 219/216 X |
| 5,481,350 | 1/1996 | Yasui et al. | 399/328 |
| 5,493,379 | 2/1996 | Kuroda et al. | 399/69 X |
| 5,528,345 | 6/1996 | Hasegawa | 399/122 |
| 5,592,276 | 1/1997 | Ohtsuka et al. | 399/33 X |

FOREIGN PATENT DOCUMENTS

| | | |
|---|---|---|
| 59-033481 | 2/1984 | Japan . |
| 4-161976 | 6/1992 | Japan . |
| 8-095406 | 4/1996 | Japan . |
| 8-305191 | 11/1996 | Japan . |

*Primary Examiner*—A. T. Grimley
*Assistant Examiner*—Sophia S. Chen
*Attorney, Agent, or Firm*—Oliff & Berridge, PLC

[57] ABSTRACT

The invention provides a fixing device in which a temperature fuse melts quickly when a heat roller becomes overheated. The heat roller, to which pressure is applied by a pressure roller placed in a fixing unit case, is axially supported by bearings which are made of synthetic resin and soften upon overheating of the heat roller. An electrical insulating cover, placed adjacent the heat roller opposite to the position of the pressure roller is fixed to an inner surface of a lower case. The electrical insulating cover has a heat collecting surface which is arcuate in cross section and placed opposed to a circumferential surface of the heat roller. The temperature fuse is fixed to the reverse side of the cover and is connected in series with an electric circuit from a power source to a halogen lamp in the heat roller.

19 Claims, 10 Drawing Sheets

FIXING UNIT FOR USE IN IMAGE FORMING APPARATUS

BACKGROUND OF THE INVENTION

1. Field of the Invention

The invention relates to a structure of an image forming apparatus, such as a copying machine, facsimile, and laser beam printer, which forms a toner image on a recording medium such as a sheet and thermally fixes the toner image onto the recording medium, thereby recording the toner image.

2. Description of Related Art

As disclosed in U.S. Pat. No. 5,528,345, a conventional laser beam printer, a kind of electrophotographic image forming apparatus, typically prints as follows. An electrostatic latent image is formed on an outer peripheral surface of a photosensitive drum using laser beams emitted from a scanner unit placed in a main printer frame. Then, toner supplied from a toner cartridge is statically applied to the electrostatic latent image to convert it into a visible image. The toner image is then transferred to the surface of a recording medium such as a sheet passing through a transfer section of the photosensitive drum. Subsequently, the recording medium passes through a heating and pressing section (nipping section) formed between a heat roller and a pressure roller in a fixing unit so that the toner image is thermally fixed to the recording medium. Finally, the recording medium is discharged from the printer by a pair of rollers comprising a discharge roller and a pinch roller.

When the heat roller becomes overheated and its temperature exceeds the normal service temperature for thermal fixing due to, for example, a breakdown of a control device, a sheet burns or a fixing unit case melts, causing a fire. Conventionally, for safety reasons, a temperature fuse is connected in series between a power source in the laser beam printer and a heater, such as halogen lamp in the heat roller. The temperature fuse is placed in an appropriate position on the outer peripheral side of the heat roller so that the temperature fuse is at a specified spatial distance from the heat roller and opposed thereto.

Generally, the heat roller in the laser beam printer consists of a cylindrical metal body such as a cylindrical aluminum body, and is grounded to protect a sheet from static electricity. Since the temperature fuse is connected to the power source as described above, the heat roller and the temperature fuse do not make electrical contact with each other or short out under any circumstance. The safety regulations for electrical equipment (explosion-proof construction regulations for general electrical equipment) usually stipulate that the heat roller and the temperature fuse are to be placed apart from each other, leaving a spatial distance of 4 mm or more.

However, since there is a low heat conductive air layer between the heat roller and the temperature fuse, the distance therebetween being a relatively long distance of 4 mm or more, the temperature of the heat roller, even when it is excessively high, must be transferred to and heat the air layer between the heat roller and the temperature fuse before being transferred to the temperature fuse. In other words, even when the heat roller becomes excessively hot, the temperature fuse takes a long time to reach a specified reaction temperature and in the meantime other components may become overheated. Such a condition is likely to raise a problem from a fire prevention viewpoint, and thus the reaction temperature of the temperature fuse must be set lower than it needs to be so that the temperature fuse reacts before the components around the heat roller become overheated. However, when the reaction temperature of the temperature fuse is set lower than it needs to be, the upper limit of the heat roller working temperature range becomes undesirably low. In this case, toner fixing requiring high temperatures is extremely hard to perform. To fix the toner to a thick sheet or envelope, or OHP sheet, the toner should be fixed at a higher temperature than that for a normal sheet.

SUMMARY OF THE INVENTION

In view of the foregoing problems, it is an object of the invention to provide a fixing unit for use in an image forming apparatus, wherein a temperature fuse quickly reacts when a heat roller becomes overheated, while the heat roller and the temperature fuse are kept electrically insulated. To achieve this object, in a fixing unit for use in an image forming apparatus according to a preferred embodiment of the invention, an image forming apparatus comprises a toner image forming device that forms a toner image on a recording medium, such as a sheet to be transported, and fixing device, having a heat roller and a pressure roller, that thermally fixes the toner image onto the recording medium. A temperature fuse is placed on a side of an electrical insulating member opposite to a side of the electrical insulating member stationarily placed adjacent an outer peripheral surface of the heat roller to cut off electric power supply to the heat roller when the heat roller becomes overheated.

With this structure, since the temperature fuse is stationarily placed and separated by the electrical insulating member from the outer peripheral surface of the heat roller, the metal heat roller and the temperature fuse do not make electrical contact with each other or short out under normal use as well as before electric power is cut off when the heat roller comes into contact with the surface of the electrical insulating member. When the heat roller becomes overheated, the heat is transferred to the temperature fuse via the electrical insulating member to quickly cause a portion of the temperature fuse to melt thereby cutting off electric power, effectively preventing a fire from occurring in the image forming apparatus.

The fixing device of the invention includes synthetic resin bearings which axially support the heat roller, and the electrical insulating member and the temperature fuse are placed on a side of the heat roller opposite to the pressure roller which applies pressure to the heat roller. When the heat roller becomes overheated, the synthetic resin bearings soften or melt and the heat roller comes into contact with the surface of the electrical insulating member. Consequently, the heat transfers quickly from the heat roller, through the inside of the electrical insulating member, to the temperature fuse, resulting in a quicker reaction of temperature fuse.

Also, the electrical insulating member of the invention has a heat collecting surface placed opposed to the heat roller to transfer heat from the heat roller to the temperature fuse. If the electrical insulating member is provided with a heat collecting surface, a large amount of heat generated from the heat roller can be transferred at one time to the temperature fuse, resulting in a faster heat transfer to the temperature fuse. In this case, if the heat collecting surface is larger than the surface area of the temperature fuse, the heat collecting effect will be improved.

The heat collecting surface of the electrical insulating member curves approximately parallel with a circumferential surface of the heat roller. The spatial distance (clearance) between the heat collecting surface and the circumferential surface of the heat roller can be maintained approximately uniform, resulting in a further improvement in the heat collecting effect.

Additionally, the electrical insulating member has a highly heat-resistant electrical insulating member between the heat roller and the temperature fuse. Thus, even when the electrical insulating member constituting the heat collecting surface is made of an inexpensive material (for example, polyethylene terephthalene) having relatively low heat resistance, electrical insulation between the temperature fuse and the heat roller can be maintained by applying a thin layer of an expensive material (for example, polyimide) having high heat resistance to the surface of the heat collecting surface.

BRIEF DESCRIPTION OF THE DRAWINGS

These and other aspects and advantages of the invention will become apparent from the following detailed description of a preferred embodiment when taken in conjunction with the accompanying drawings, in which.

DETAILED DESCRIPTION OF PREFERRED EMBODIMENT

Figure 1:
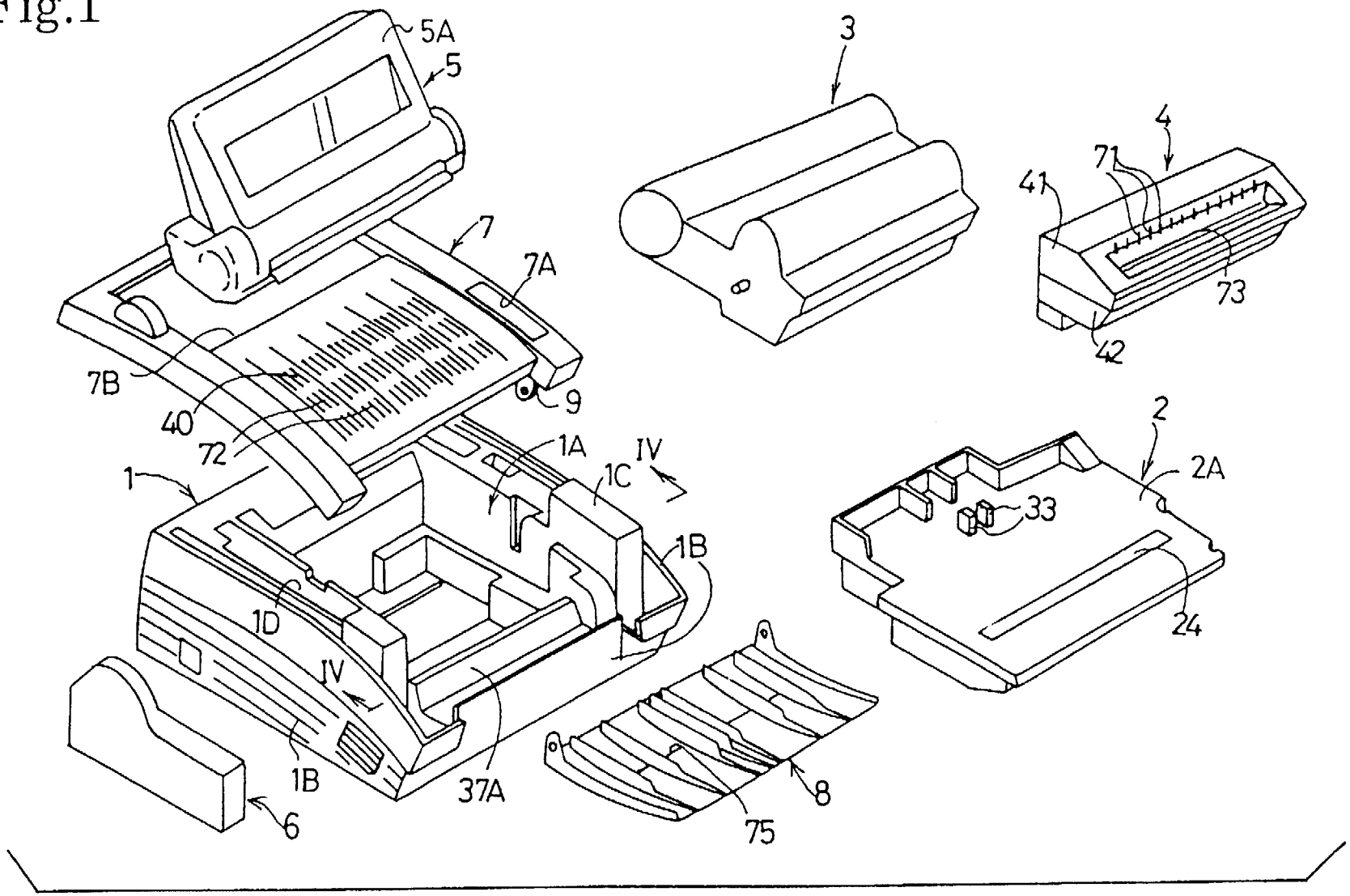
FIG. 1 is a partial perspective view of a laser beam printer according to the invention.

While the invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate identical elements.

Figure 2:
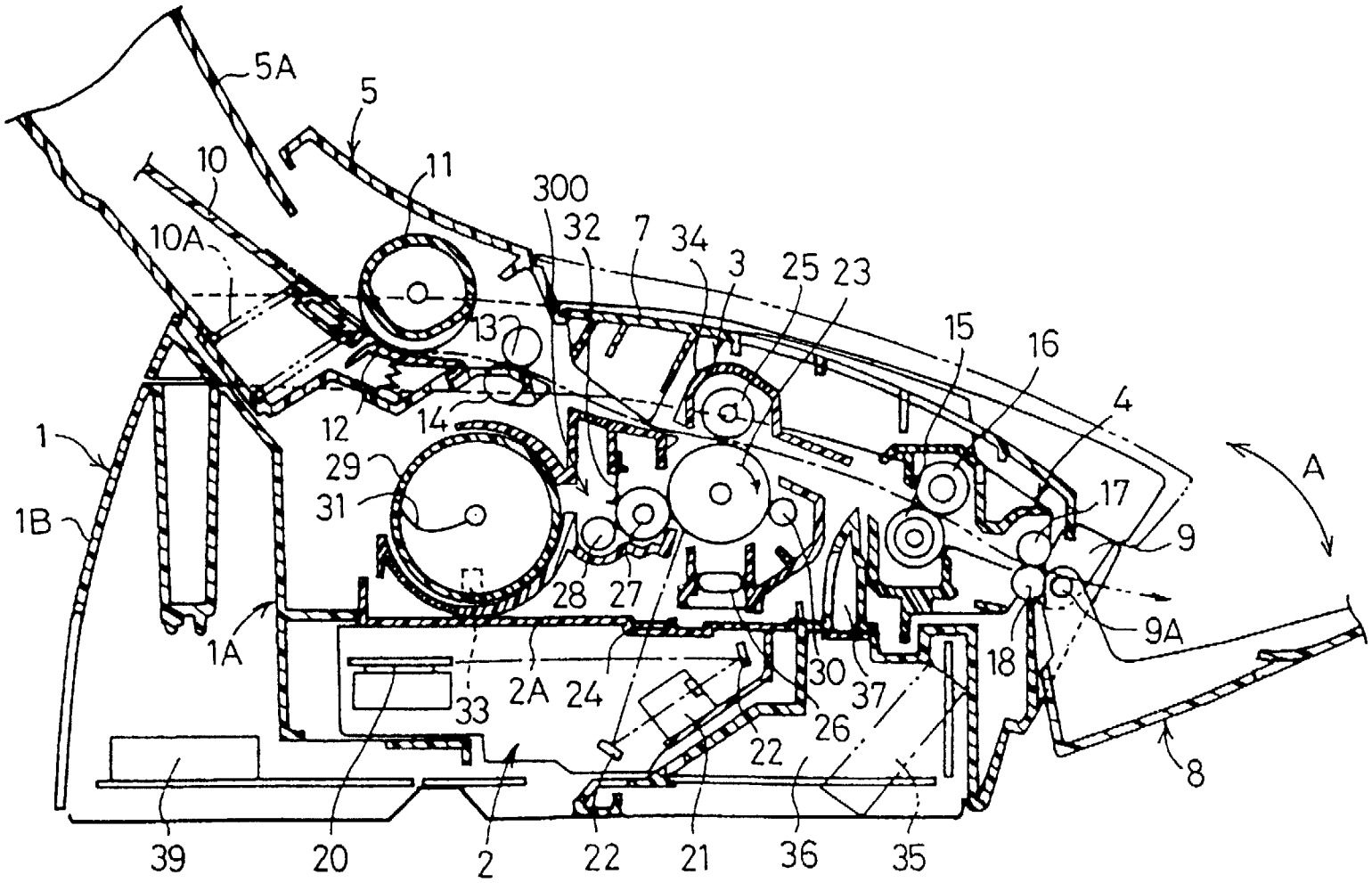
FIG. 2 is a schematic cross-sectional view of the laser printer of FIG. 1.

FIG. 1 is a partial perspective view of a laser beam printer according to the invention, and FIG. 2 is a schematic cross-sectional view of the laser printer.

As shown in FIG. 1, a synthetic resin main printer frame 1 of the laser beam printer comprises a main frame 1, in which a scanner 2, a process unit 3, a fixing unit 4, and a sheet feed unit 5 can be mounted from the top, and a main cover 1B which covers the outer surfaces of all sides (front, rear, right, and left sides) of the main frame 1A. The main frame 1A and the main cover 1B are integrally formed into the main printer frame by, for example, injection molding.

A drive unit 6 including a drive motor (not shown) and rows of gears (not shown) is inserted from the bottom of the main printer frame 1, and stationarily mounted, as shown in FIG. 1, in a mounting recess 1D between the inner left surface of the main cover 1B and the left side of the main frame 1A adjacent thereto. Further, a synthetic resin top cover 7 covers the upper surfaces of the main frame 1A. The main cover 1B has a hole 7A, into which an upwardly projecting operation panel 1C on the right side of the main frame 1A is inserted, and another hole 7B into which a base of the sheet feed unit 5 is inserted. A base of a sheet discharge tray 8 is mounted so as to rotate in a direction of the arrow A in FIG. 2, around a shaft 9A provided on brackets 9, 9 (only one bracket is shown in FIG. 1), which project from both sides of the front end of the top cover 7. When the sheet discharge tray 8 is not used, it can be folded over the upper surface of the top cover 7.

The leading edge of a sheet P stacked in a feeder case 5A of the sheet feed unit is pressed against a sheet feed roller 11 by a support plate 10 with a pressing spring 10*a* in the feeder case 5A. A sheet is separated from other sheets by the sheet feed roller 11 which is rotationally driven by the drive unit 6 and a separation pad 12. The separated sheet P is fed into the process unit 3 by a pair of vertically placed resistor rollers 13 and 14. Then, an image is formed using toner on the surface of the sheet P in the process unit 3. The image is fixed to the sheet P by a heat roller 15 and a pressure roller 16 of the fixing unit 4 to be described later. Finally, the sheet P is discharged to the sheet discharge tray 8 via a sheet discharge section 170 comprising a plurality of sheet discharge rollers 17 and a plurality of pinch rollers 18 which are located downstream in the fixing unit case.

At a lower portion of the process unit 3, as viewed from the top, at approximately the center of the open box-type main frame 1A in the main printer frame 1, an upper support plate 2A of the scanner unit 2 is fixed with screws, for example, to a stay formed integrally with the upper side of a bottom plate of the main frame 1A. In the scanner unit 2, a laser emitting section (not shown), a polygon mirror 20, a lens 21, a reflection mirror 22, for example, are placed on the lower side of the synthetic resin upper support plate 2A. Exposure is performed by irradiating an outer peripheral surface of a photosensitive drum 23 in the process unit 3 with laser beams which pass through a glass plate 24 covering a lateral scanning hole extending over the upper support plate 2A along the axis of the photosensitive drum 23.

As shown in FIG. 2, the process unit 3 comprises the photosensitive drum 23, a transfer roller 25 placed in contact therewith, a charger 26, for example, of the scorotron type, placed below the photosensitive drum 23, a developing unit 300 having a developing roller 27 and a supply roller 28 placed upstream of the photosensitive drum 23 in the sheet feeding direction, a toner supply section or removable toner cartridge 29 placed upstream of the developing unit, and a cleaning roller 30 placed downstream of the photosensitive drum 23. On the outer peripheral surface of the photosensitive drum 23, an electrostatic latent image is formed by emitting laser beams from the scanner unit 2 to a charged layer formed by the charger 26.

Toner in the toner cartridge 29 is agitated by an agitator 31 and discharged, and then deposited on an outer peripheral surface of the developing roller 27 via the supply roller 28. The thickness of the toner layer on the developing roller 27 is controlled by a blade 32. The electrostatic latent image on the photosensitive drum 23 is converted into a visible image when the toner is applied thereto from the developing roller 27, and the visible image is transferred onto the sheet P passing between the transfer roller 25 and the photosensitive drum 23. Then, the toner remaining on the photosensitive drum 23 is temporarily reclaimed by the cleaning roller 30, returned to the photosensitive drum 23 in specified timing, and reclaimed into the process unit 3 by the developing roller 27.

The upper support plate 2A of the scanner unit 2 is provided with an upwardly projecting toner sensor 33. The toner sensor 33 comprised of a pair of light-emitting and light-receiving sections, is placed within a recess at the bottom of the toner cartridge 29, and can detect the presence of toner in the toner cartridge. The process unit 3 is incorporated into a synthetic resin case 34, and is removably mounted in the main frame 1A.

On the lower side of the linkage of the front of the main frame 1A and the front of the main cover 1B, a housing 36 for accommodating a cooling fan 35 is connected to an air duct 37 which extends laterally and perpendicularly to the sheet P passing direction. An upper plate 37A (see FIG. 3) of the air duct 37 is an inverted V-shaped in cross section and is placed between the process unit 3 and the fixing unit 4 to interrupt the heat generated from the heat roller in the fixing unit 4 from transferring directly to the process unit 3. Cooled air generated from the cooling fan 35 passes through the air duct 37 and flows along one side of the bottom of the main frame 1A to cool a power source 39 (see FIG. 2) and a drive motor (not shown) of the drive unit 6. Additionally, the cooled air blows out of a plurality of slits 38 provided on the process unit 3 side of the upper plate 37A, travels up between the process unit 3 and the fixing unit 4, and is discharged from a plurality of exhaust holes 40 provided at the top cover 7. The cooled air serves as an air curtain and prevents the steam generated from the fixing unit 4 from flowing toward the process unit 3 (toward the sheet feed unit 5).

Next, the detailed structure of the fixing unit 4 will be described with reference to FIG. 3 and FIGS. 5 to 12.

The heat-resistant synthetic resin case of the fixing unit 4 is divided into an upper case 41 and a lower case 42, which are removably engaged at engaging latches (not shown) on both sides of both cases 41 and 42. On the lower side of the upper case 41, both axial ends 52, 52 of the pressure roller 16 are supported against the pressing springs 53 and mounting holes 55 on both sides of the upper case 41 via synthetic resin 54 bearings 54 which are vertically movable and impossible to fall. The pressure roller 16 is made by a core rod 50 covered with an elastic layer 50 made of heat-resistant soft rubber. The lower side of a circumferential surface of the pressure roller 16 is always pressed against the upper side of a circumferential surface of the heat roller 15 (see reference numeral 80 in FIGS. 10–11).

Figure 5:
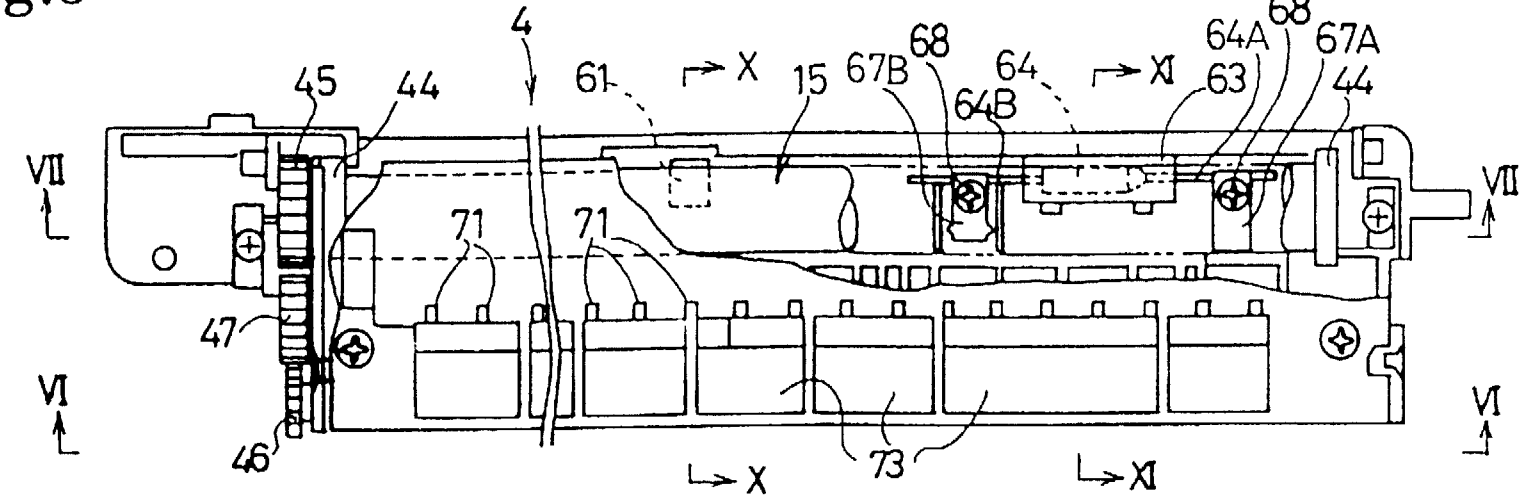
FIG. 5 is a partial broken plan view of the fixing device of FIG. 3.
Figure 6:
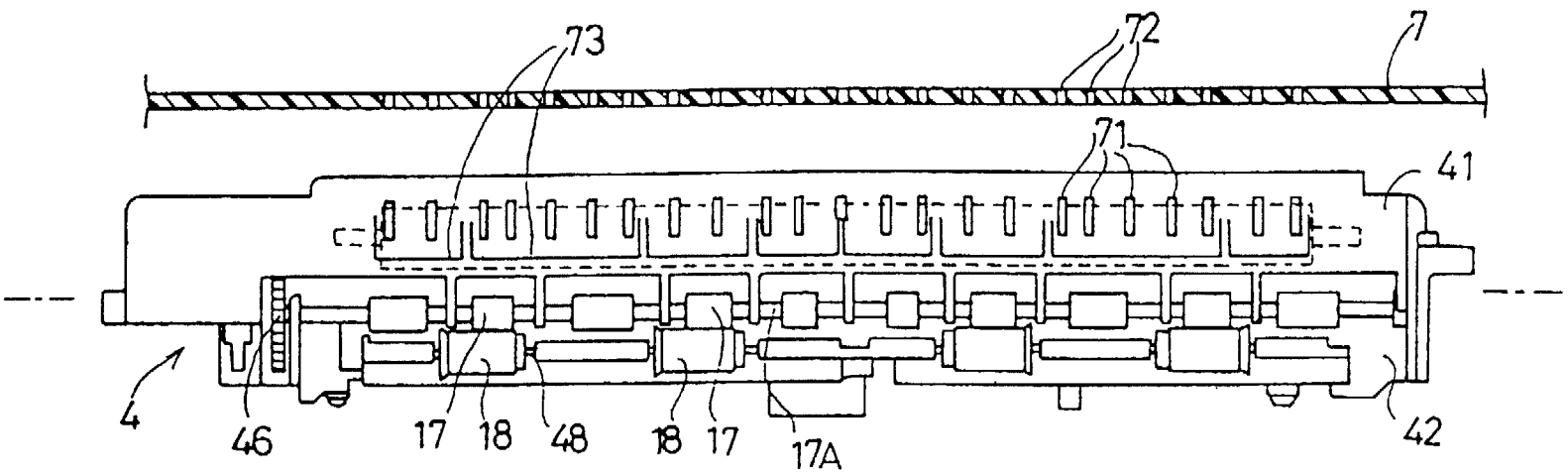
FIG. 6 is a cross-sectional view of the fixing device of FIG. 5 taken along the line VI—VI.

Upstream on the sheet P passage in the lower case 42, the cylindrical heat roller 15 is rotatably axially supported via ring-shaped bearings 44, 44 preferably made of synthetic resin such as PI (polyimide) and PPS (polyphenylene sulfite). The heat roller is made of highly heat conductive metal such as aluminum and contains a thin cylindrical lamp 43, preferably halogen, in its inside diameter. Downstream on the sheet P passage, a plurality of pairs of rollers each comprised of a sheet discharge roller 17 and a pinch roller 18 are rotatably axially supported. A driving force is transmitted from a transmission gear (not shown) placed downstream in the driveline of the drive unit 6 to a synthetic resin gear 45 engaged with one side of the heat roller 15, and further to a driven gear 46 attached to the sheet discharge rollers 17 via two intermediate gears 47 (only one of them is shown in FIG. 5), and thereby the heat roller 15 and the sheet discharge rollers 17 are driven to rotate synchronously.

Figure 10:
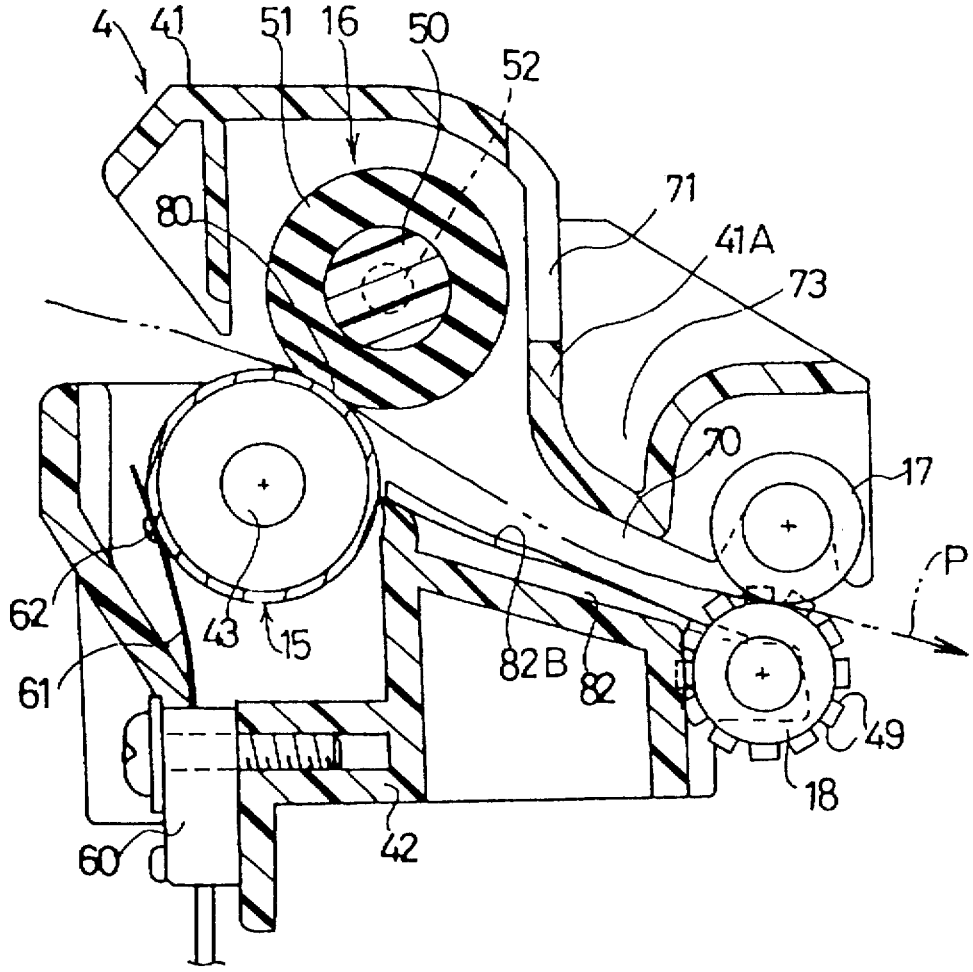
FIG. 10 is an enlarged cross-sectional view taken along the line X—X of FIG. 5.
Figure 11:
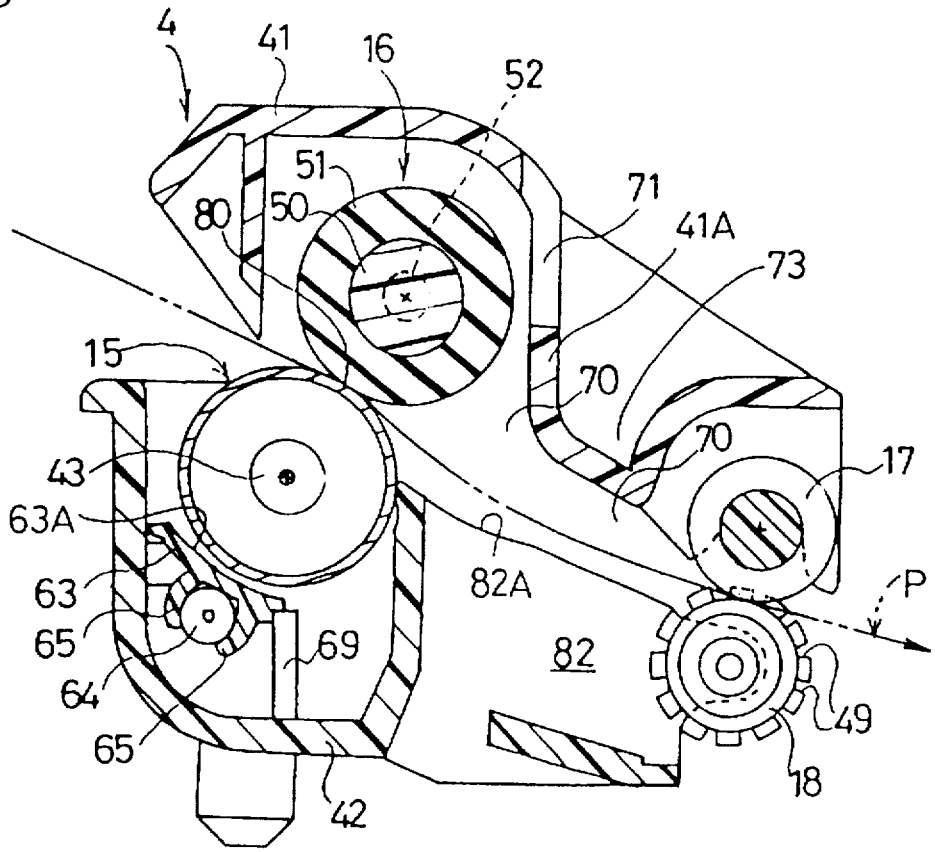
FIG. 11 is an enlarged cross-sectional view of the fixing unit of FIG. 5 taken along the line XI—XI.

The sheet discharge rollers 17 are formed integrally with their shaft 17A whereas the pinch rollers 18 are supported elastically and rotatably by a shaft made of coil spring 48. As shown in FIGS. 10 and 11, one end of each rubber pinch roller 18 is made larger in diameter and a number of cut grooves 49 are formed on an outer peripheral portion thereof. The sheet P is ejected with its rear edge caught in the groove, and thereby pinching of the rear edge of the sheet P by the pinch rollers 18 and the sheet discharge rollers 17 is released to discharge the sheet smoothly.

It is desirable to bring the lower side of the upper wall in the midway portion of the upper case 41 closer to the upper side of the sheet passage 70 for the purpose of narrowing at least the upper space of the sheet passage 70 between the fixing section 140 of the fixing unit 4, composed of the heat roller 15 and the pressure roller 16, and the sheet discharge section 170 of the fixing unit 4, which is downstream of the fixing section 140 and composed of the sheet discharge rollers 17 and the pinch rollers 18. To achieve this, the upper wall in the midway portion of the upper case 41 curves in a downwardly projecting fashion as shown in FIGS. 3, 5, 6, 10, and 11. As a result, the volume of the space on the upper side of the sheet passage 70 in the fixing unit case, where air heated with the heat generated from the heat roller 15 and steam generated from the sheet P during thermal fixing stagnate, is reduced. Consequently, the sheet P passing on the sheet passage 70 is substantially prevented from being exposed to a hot and humid atmosphere. Consequently, the sheet P does not swell up or reabsorb excessive steam. Thus curling of the sheet P when cooled upon discharge is avoided.

An approximately perpendicular wall 41A of the above-mentioned downwardly projecting portion is formed near an outer peripheral surface of the pressure roller 16 placed on the upper side of the fixing unit to reduce as much as possible the volume of the space susceptible to stagnation of hot and humid air in the outer peripheral portion of the pressure roller 16. Moreover, in the relatively upper portion of the approximately perpendicular wall 41A, a plurality of steam release holes 71 are provided on a side closer to the outer peripheral surface of the pressure roller 16 along the sheet P width direction to release the steam generated in the fixing section 140 to the outside. A number of discharge holes 72 are also provided on the top cover 7 along the sheet P width direction to discharge the steam released from the steam release holes 71 to the outside of the printer (see FIGS. 2 and 3).

The steam generated in the fixing section 140 of the fixing unit 4 flows along an ascending air current and is discharged from the fixing unit 4 through the steam release holes 71 on the wall 41A, and is then discharged from the printer through the discharge holes 72. Since no steam stagnates within the case of the fixing unit 4 and no dew forms on inner surfaces of the upper case 41, inconveniences such as reabsorption of excess moisture by the sheet P passing on the sheet passage from the fixing section 140 to the sheet discharge section 170 and the dropping of waterdrops on the sheet P are eliminated.

Further, the downwardly projecting portion in the midway portion of the upper case 41 is used as a waterdrop receiver 73. In addition, lateral guide ribs 74, 74 are provided to project downwardly to a position approximately right above the waterdrop receiver 73 beneath the top cover 7 (see FIG. 3). By this, the waterdrops produced by condensation on the lower surface of the top cover 7 and flowing therealong are blocked by the guide ribs 74 and guided to drop into and stagnate in the waterdrop receiver 73, instead of dropping to the sheet discharge side.

Figure 3:
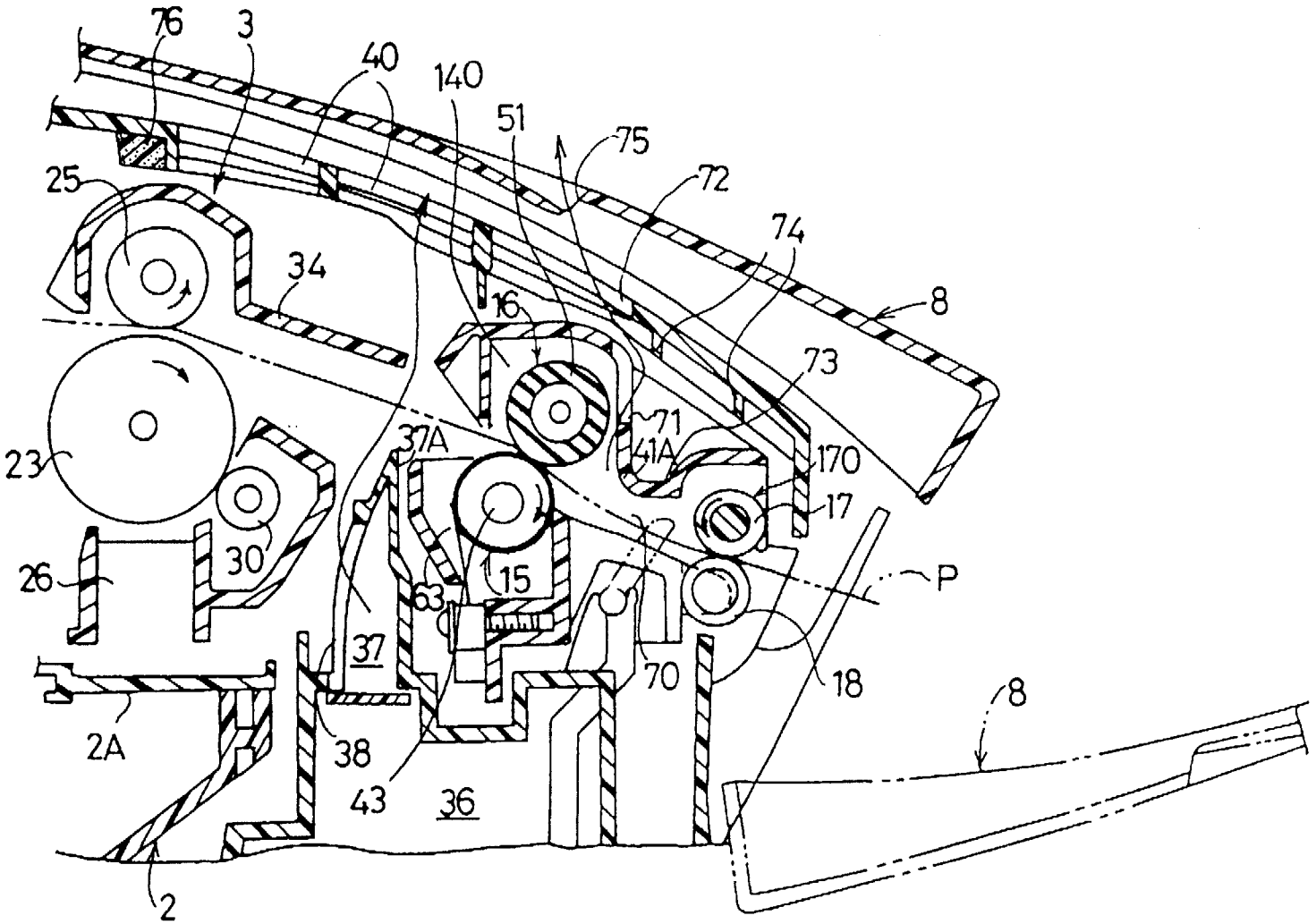
FIG. 3 is a cross-sectional side view of a preferred embodiment of a fixing device according to the invention.
Figure 4:
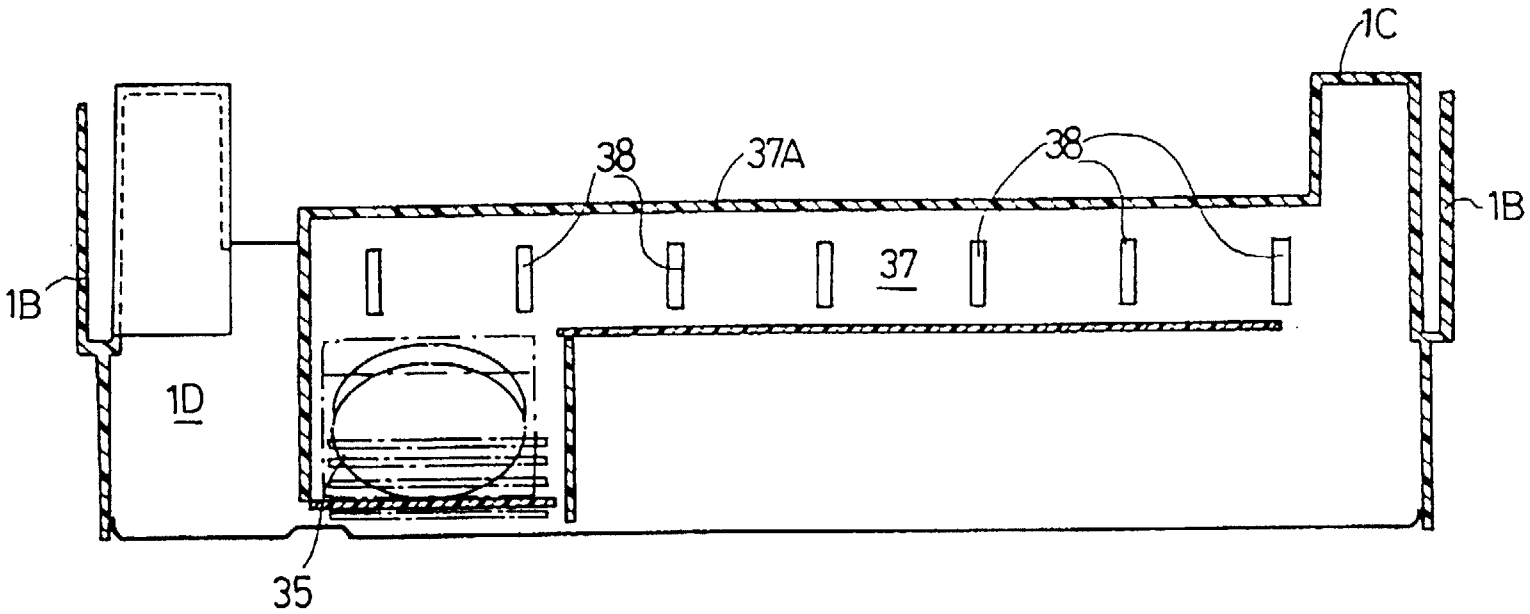
FIG. 4 is a cross-sectional view of the laser beam printer of FIG. 1 taken along the line IV—IV.

As shown in FIG. 3, a long exhaust hole 75 is provided in the sheet discharge tray 8 along the sheet P width direction. With this structure, steam can be prevented from stagnating in the space between the sheet discharge tray 8 and the top cover 7 when the sheet is discharged with an image formed thereon while the sheet discharge tray 8 covers the upper portion of the top cover 7.

Moreover, as shown in FIG. 3, a hygroscopic material 76, such as a sponge, is provided beneath the top cover 7 over a large area. Material 76 may be provided over a long length in the sheet P width direction and over an appropriate width in the sheet P passing direction, in an upper position of the case 34 of the process unit 3, that is, downstream of the sheet feed unit 5 on the sheet passage. Steam flowing beneath the top cover 7 toward the sheet feed unit 5 is absorbed by the hygroscopic material 76 and prevented from condensing into waterdrops and from dropping on the surface of the sheet P fed from the sheet feed unit 5.

As shown in FIGS. 10 and 11, a plurality of guide ribs 82 are placed along the sheet P width direction at appropriate intervals on the discharge side of the heat roller 15. The upper ends (guide surfaces) 82A and 82B make sliding contact with the leading edge of the sheet P and guide the sheet to the sheet discharge section 170.

Figure 7:
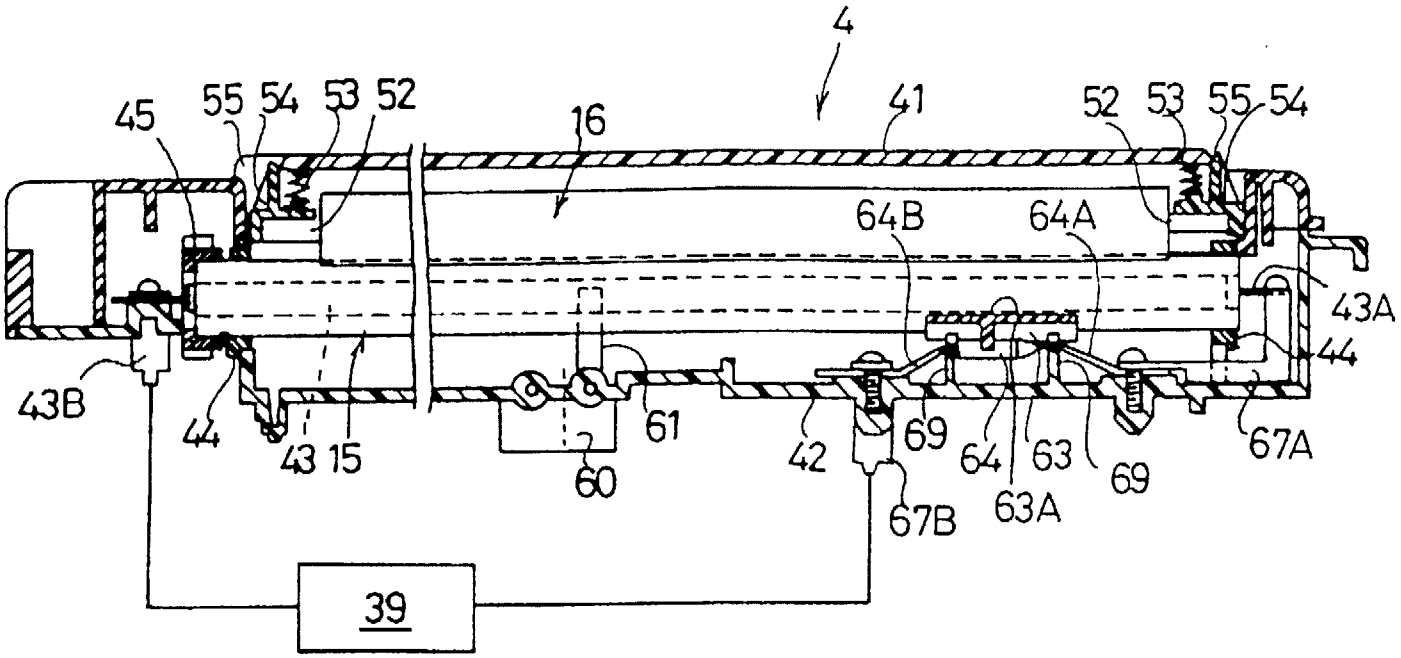
FIG. 7 is a cross-sectional view of the fixing unit of FIG. 5 taken along the line VII—VII.
Figure 8:
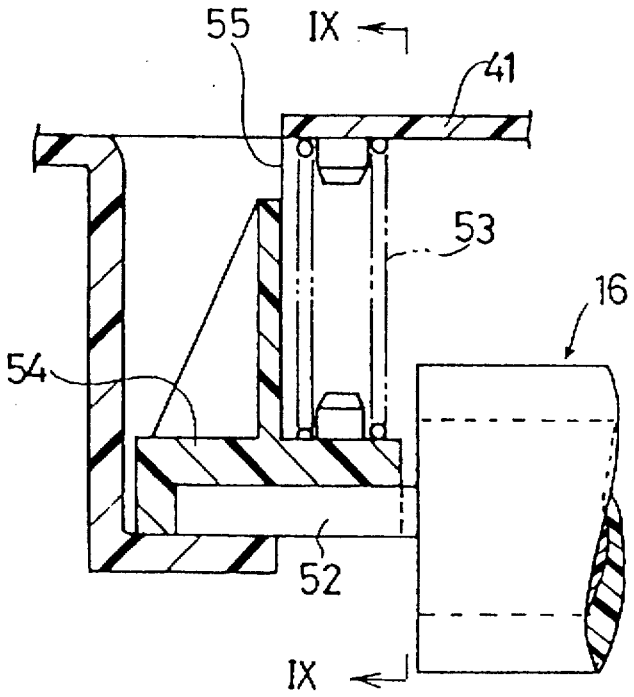
FIG. 8 is a magnified cross-sectional view showing a pressing device of a pressure roller.
Figure 9:
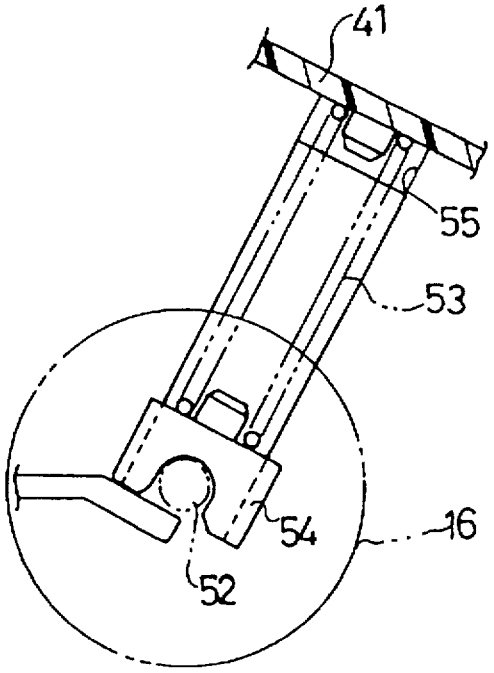
FIG. 9 is a cross-sectional view of the pressing device of FIG. 8 taken along the line IX—IX.

Temperature control of the fixing unit 4 will now be described. As shown in FIGS. 7 and 10, the temperature of the peripheral surface of the heat roller 15 is detected by a thermostat 62 (alternatively, a temperature sensor) controlled by a controller (not shown). The thermostat 62 is mounted on an elastic metal support 61 extending from a socket 60 screwed at the approximate lateral center of the lower case 42, into contact with the outer peripheral surface of the heat roller 15. The controller (not shown) controls the temperature of the heat roller 15 to the normal service temperature based on the temperature indicating signals issued from the thermostat 62.

As shown in FIGS. 7, 11, 12A, and 12B, an electrical insulating cover 63 made of, for example, synthetic resin, or ceramic, is provided adjacent inner surfaces of the lower case 42 to place a temperature fuse 64 in such a manner that the temperature fuse 64 can react quickly to an overheated heat roller 15 while leaving a specified spatial distance, which meets safety regulations between the temperature fuse 64 and the heat roller 15. A heat collecting surface 63A of the cover 63 is greater in length and thickness than the temperature fuse 64 and curved in a concave fashion so as to be approximately parallel with the outer peripheral surface of the heat roller 15. In order to place the heat collecting surface 63A in the vicinity of and opposed to the outer peripheral surface of the heat roller 15, the cover 63 is mounted on a pair of supports 69, 69, which are provided integrally and projectingly on an inner surface of the lower case 42 on the lower side of the heat roller 15, that is, on the side of the heat roller opposite to the pressure roller 16. On the reverse side of the cover 63, the temperature fuse 64 is stationarily mounted via a pair of holding latches 65 provided integrally and projectingly on the reverse side of the cover.

Alternatively, when inexpensive PET (polyethylene terephthalate) having relatively low heat resistance (approximately 180° C.) is used for the cover 63, the heat collecting surface 63A may be provided with a thin layer 90 made of PI (polyimide) having high heat resistance (approximately 250° C.).

In the above cases, even when the clearance between the heat collecting surface of the cover 63 and the outer peripheral surface of the heat roller 15 is as small as 0.5 mm, the size of the cover 63 is set so that the spatial distance from the outer peripheral surface of the heat roller 15 to the surfaces of lead wires 64A and 64B is 4 mm or more. The lead wires are laid along the surface of the cover 63, and connected to the temperature fuse 64 at both ends. The reaction temperature of the temperature fuse 64 is higher (137° C. in the preferred embodiment) than the upper limit (up to 130° C. in the preferred embodiment) of the normal thermal fixing temperature of the heat roller 15.

Figure 12A:
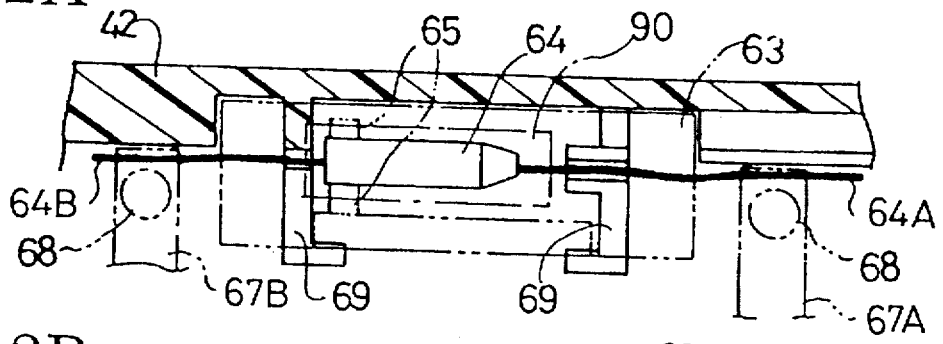
FIG. 12A is a magnified plan view of a mounting portion of a temperature fuse.
Figure 12B:
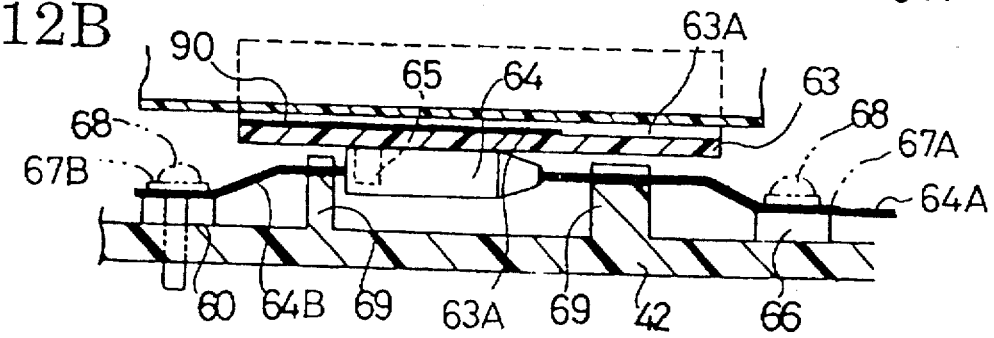
FIG. 12B is a magnified cross-sectional view of the mounting portion of the temperature fuse.

The lead wires 64A and 64B connected to both ends of the temperature fuse 64 are fixed to a base 66 provided in the lower case 42 via external metal terminals 67A and 67B and screws 68, 68 (see FIGS. 11, 12A, and 12B). One of the external terminals 67A is connected to one of the terminals 43A of the halogen lamp 43 and the other external terminal 67B to a power source 39, while the other terminal 43B of the halogen lamp is connected to the power source 39. Thereby, the temperature fuse 64 is connected in series with the power supply circuit from the power source 39 to the halogen lamp 43 (see FIG. 7).

When the heat roller 15 becomes excessively hot for one reason or another, the ring-shaped bearings 44, 44 made of heat-resistant and thermoplastic synthetic resin (in the preferred embodiment, PPS; polyphenylene sulfite—melting point: approximately 280° C., heat conductivity: 0.007 cal/cmsec° C.) start softening or melting. Since the heat roller 15 is always pressed by the pressure roller 16, the pressure applied brings the heat roller 15 closer to the heat collecting surface 63A of the cover 63. Finally, the circumferential surface of the heat roller 15 makes contact with the heat collecting surface 63A of the cover. The heat then transfers quickly from the heat roller 15, through the inside of the cover 63, to the temperature fuse 64 to cause a reaction within the temperature fuse 64 which quickly cuts off electrical power supplied from the power source 39 to the halogen lamp 43. More particularly, a metal portion of temperature fuse 64 melts to cut off the electrical power supply.

Since the cover 63 is the electrical insulating member, the metal heat roller 15 and the temperature fuse 64 do not make electric contact with each other to develop a short circuit under normal use as well as before electric power is cut off when the heat roller 15 is pressed to come into contact with the cover 63. Moreover, if the heat collecting surface 63A of the cover 63 is made to have a large area approximately parallel with the circumferential surface of the heat roller 15, the efficiency in heat conductivity, upon overheating of the heat roller, from the heat roller to the temperature fuse 64 via the cover 63 can be improved. This results in a more quick reaction of the temperature fuse 64.

As shown in the preferred embodiment, the heat roller 15 is axially supported so as to move, when overheated, to the opposite side to the pressure roller 16, which applies pressure to the heat roller. The heat roller 15 makes contact, at its circumferential surface, with the heat collecting surface 63A of the cover 63, so the temperature fuse 64 can produce a quick reaction effect.

As the toner image forming device of the invention, aside from the type employed in the preferred embodiment in which an image formed on the photosensitive drum 23 is transferred onto a sheet, a different type described below may be employed. A number of linear apertures are provided in a direction intersecting with the sheet passage and an aperture electrode is provided for each aperture, while a back electrode is placed facing an array of aperture electrodes. By the application of a voltage to the aperture electrodes based on image data, toner passes though the apertures related to the electrodes to which a voltage is applied, and a toner image is formed on a sheet passing between the array of electrodes and the back electrode.

While the invention has been described in conjunction with a specific embodiment thereof, it is evident that many alternatives, modifications and variations may be apparent to those skilled in the art. Accordingly, the preferred embodiment of the invention as set forth herein is intended to be illustrative, not limiting. Various changes may be made without departing from the spirit and scope of the invention as defined in the following claims.

What is claimed is:

1. An image forming apparatus comprising:

a toner image forming device that forms a toner image on a recording medium; and a fixing device positioned downstream of the toner image forming device in a recording medium feeding direction of the image forming apparatus, the fixing device thermally fixing the toner image onto the recording medium and comprising:

a heat roller;

a pressure roller disposed adjacent the heat roller, the pressure roller applying pressure to the heat roller;

an electrical insulating member; and a temperature fuse, the temperature fuse being positioned on a side of the electrical insulating member that is opposite to a side of the electrical insulating member positioned adjacent an outer peripheral surface of the heat roller so that when the heat roller becomes overheated, the heat is transferred to the temperature fuse via the electrical insulating member to cause the temperature fuse to react and cut off electric power supply to the heat roller, wherein the fixing device has synthetic resin bearings which axially support the heat roller and which melt when the heat roller overheats to allow the heat roller to be pushed by the pressure roller into contact with the electrical insulating member to cut off the electric power supply to the heat roller.

2. The image forming apparatus according to claim 1, wherein the electrical insulating member and the temperature fuse are positioned adjacent the periphery of the heat roller at a position opposite across a diameter of the heat roller to a position of the pressure roller.

3. The image forming apparatus according to claim 1, wherein the electrical insulating member is heat-resistant.

4. The image forming apparatus according to claim 1, wherein the electrical insulating member is mounted on supports which are integral with a lower case of the image forming apparatus.

5. The image forming apparatus according to claim 1, wherein the temperature fuse is stationarily mounted to the electrical insulating member by a pair of holding latches.

6. The image forming apparatus according to claim 1, wherein the temperature fuse is connected in series with a power source and a halogen lamp within the heat roller.

7. The image forming apparatus of claim 1, wherein the temperature fuse comprises a metal portion which melts to cut off the electric power supply to the heat roller.

8. An image forming apparatus comprising:

a toner image forming device that forms a toner image on a recording medium; and a fixing device positioned downstream of the toner image forming device in a recording medium feeding direction of the image forming apparatus, the fixing device thermally fixing the toner image onto the recording medium and comprising:

a heat roller;

a pressure roller disposed adjacent the heat roller, the pressure roller applying pressure to the heat roller;

an electrical insulating member, and a temperature fuse, the temperature fuse being positioned on a side of the electrical insulating member that is opposite to a side of the electrical insulating member positioned adjacent an outer peripheral surface of the heat roller so that when the heat roller becomes overheated, the heat is transferred to the temperature fuse via the electrical insulating member to cause the temperature fuse to react and cut off electric power supply to the heat roller, and wherein the electrical insulating member has a heat collecting surface placed opposed to the heat roller to transfer heat from the heat roller to the temperature fuse, wherein the heat collecting surface of the electrical insulating member curves approximately concentrically with a circumferential surface of the heat roller.

9. The image forming apparatus according to claim 8, further comprising a thin layer of heat-resistant material disposed on a surface of the heat collecting surface and having a higher heat-resistant capacity than the heat collecting surface.

10. The image forming apparatus according to claim 8, wherein the heat collecting surface has a larger surface area than a surface area of the temperature fuse.

11. A fixing device for an image forming apparatus, the fixing device thermally fixing a toner image onto a recording medium and comprising:

a heat roller;

a pressure roller disposed adjacent the heat roller for applying pressure to the heat roller;

an electrical insulating member;

a temperature fuse, the temperature fuse being positioned on a side of the electrical insulating member that is opposite to a side of the electrical insulating member positioned adjacent an outer peripheral surface of the heat roller so that when the heat roller becomes overheated, the heat is transferred to the temperature fuse via the electrical insulating member to cause the temperature fuse to react and cut off electric power supply to the heat roller; and synthetic resin bearings that axially support the heat roller at axial ends thereof and which melt when the heat roller overheats to allow the heat roller to be pushed by the pressure roller into contact with the electrical insulating member to cut off the electric power supply to the heat roller.

12. The fixing device according to claim 11, wherein the electrical insulating member and the temperature fuse are positioned at a location adjacent the outer peripheral surface of the heat roller opposite across a diameter of the heat roller to a position of the pressure roller.

13. The fixing device according to claim 11, wherein the electrical insulating member is heat-resistant.

14. The fixing device of claim 11, wherein the temperature fuse comprises a metal portion which melts to cut off the electric power supply to the heat roller.

15. A fixing device for an image forming apparatus, the fixing device thermally fixing a toner image onto a recording medium and comprising:

a heat roller;

a pressure roller disposed adjacent the heat roller for applying pressure to the heat roller;

an electrical insulating member; and a temperature fuse, the temperature fuse being positioned on a side of the electrical insulating member that is opposite to a side of the electrical insulating member positioned adjacent an outer peripheral surface of the heat roller so that when the heat roller becomes overheated, the heat is transferred to the temperature fuse via the electrical insulating member to cause the temperature fuse to react and cut off electric power supply to the heat roller, wherein the electrical insulating member has a heat collecting surface placed opposed to the heat roller to transfer heat from the heat roller to the temperature fuse, and wherein the heat collecting surface of the electrical insulating member curves approximately concentrically with a circumferential surface of the heat roller.

16. The fixing device according to claim 15, further comprising a thin layer of heat-resistant material disposed on a surface of the heat collecting surface and having a higher heat-resistant capacity than the heat collecting surface.

17. The fixing device according to claim 15, wherein the heat collecting surface has a larger surface area than a surface area of the temperature fuse.

18. In a fixing device for an image forming apparatus, a method comprising the steps of:

positioning an electrical insulating member adjacent an outer peripheral surface of a heat roller;

positioning a temperature fuse on a side of the electrical insulating member opposite to a side of the electrical insulating member positioned adjacent the outer peripheral surface of a heat roller; and transferring heat, when the heat roller overheats, to the temperature fuse via the electrical insulating member to cause the temperature fuse to react and cut off electric power supply to the heat roller, wherein the step of transferring heat comprises providing the fixing device with synthetic resin bearings from axially supporting the heat roller so that when the heat roller overheats the bearings melt to allow the heat roller to be pressed into contact with the electrical insulating member by a pressing roller.

19. The method of claim 18, wherein the step of transferring heat comprises providing the temperature fuse with a metal portion which melts to cut off the electric power supply to the heat roller.

* * * * *